US009422831B2

(12) United States Patent
Noguchi et al.

(10) Patent No.: US 9,422,831 B2
(45) Date of Patent: Aug. 23, 2016

(54) CONDENSER

(71) Applicant: KABUSHIKI KAISHA TOSHIBA, Minato-ku (JP)

(72) Inventors: Taro Noguchi, Suginami-ku (JP); Shota Tsuda, Yokohama (JP); Hiroshi Saeki, Komae (JP); Takeshi Fujisawa, Yokohama (JP); Shinichirou Ohashi, Ota-ku (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 229 days.

(21) Appl. No.: 14/312,969

(22) Filed: Jun. 24, 2014

(65) Prior Publication Data

US 2015/0000879 A1 Jan. 1, 2015

(30) Foreign Application Priority Data

Jun. 27, 2013 (JP) ..... 2013-134450

(51) Int. Cl.

*F01K 17/00* (2006.01)
*F01K 9/00* (2006.01)
*F28B 1/06* (2006.01)
(Continued)

(52) U.S. Cl.

CPC ..... *F01K 9/003* (2013.01); *F01K 11/02* (2013.01); *F28B 1/06* (2013.01); *F01D 25/30* (2013.01)

(58) Field of Classification Search

CPC ..... F01K 9/003; F01K 11/02; F28B 1/06; F01D 25/30
USPC ..... 60/685, 687, 690, 694; 415/211.1, 415/211.2
See application file for complete search history.

(56) References Cited

U.S. PATENT DOCUMENTS 2,394,685 A 2/1946 Hall
3,575,392 A * 4/1971 Stoker ..... F28B 3/04 165/114
3,594,095 A * 7/1971 Trassel ..... F01D 3/02 415/108
(Continued)

FOREIGN PATENT DOCUMENTS

JP 2002-054403 A 2/2002
JP 2002-195786 A 7/2002
(Continued)

OTHER PUBLICATIONS

Extended European Search Report issued Dec. 12, 2014 in Patent Application No. 14174844.2.
(Continued)

*Primary Examiner* — Hoang Nguyen
(74) *Attorney, Agent, or Firm* — Oblon, McClelland, Maier & Neustadt, L.L.P

(57) ABSTRACT

A condenser 10 is disposed under a steam turbine 100 including a downward exhaust-type exhaust chamber. The condenser 10 includes: a condenser main body part 20; a connecting body part 30 connecting the exhaust chamber 122 and the condenser main body part 20 and having a pair of lateral sidewalls 31, 32 whose inner wall surfaces 31*a*, 32*a* are inclined more outward in terms of the perpendicular direction as they go more downstream; and a pair of plate-shaped members 40*a*, 40*b*, 41*a*, 41*b* which are provided on inner wall surfaces 35*a*, 36*a* of longitudinal sidewalls 35, 36, the pair of plate-shaped members 40*a*, 40*b*, 41*a*, 41*b* being located across a position of an inlet 33 of the connecting body part 30 and on more outer sides than the position of the inlet 33 in terms of the perpendicular direction, projecting in the turbine rotor axial direction, and extending downstream.

7 Claims, 5 Drawing Sheets

(51) Int. Cl.
*F01K 11/02* (2006.01)
*F01D 25/30* (2006.01)

(56) References Cited

U.S. PATENT DOCUMENTS 4,189,927 A 2/1980 Gray
4,287,718 A * 9/1981 Dickey ..... F01D 25/28 376/285
6,447,247 B1 9/2002 Geiger
2003/0196577 A1 * 10/2003 Lefcort ..... F23G 5/002 110/342
2010/0303620 A1 * 12/2010 Navjot ..... F01D 25/26 415/211.2

FOREIGN PATENT DOCUMENTS

JP 2009-103099 A 5/2009
WO WO 99/51858 A1 10/1999

OTHER PUBLICATIONS

Office Action issued Apr. 15, 2015 in Korean Patent Application No. 10-2014-0078188.

* cited by examiner

CONDENSER

CROSS-REFERENCE TO RELATED APPLICATION

This application is based upon and claims the benefit of priority from Japanese Patent Application No. 2013-134450, filed on Jun. 27, 2013; the entire contents of which are incorporated herein by reference.

FIELD

Embodiments described herein relate generally to a condenser.

BACKGROUND

Improvement in thermal efficiency of a steam turbine used in a thermal power station and the like has become an important task leading to efficient use of energy resources and a reduction in carbon dioxide ($CO_2$) emission. Effectively converting given energy to mechanical work makes it possible to achieve the improvement in thermal efficiency of a steam turbine. To achieve this, reducing various internal losses is required.

The internal losses of the steam turbine includes a profile loss ascribable to a blade shape, turbine cascade losses based on a secondary flow loss of steam, a leakage loss of steam, a moisture loss of steam, and so on, passage part losses in passages other than a cascade, represented by a steam valve and a crossover pipe, turbine exhaust losses ascribable a turbine exhaust chamber, condenser internal losses occurring inside a condenser, and so on.

In a steam turbine including a turbine exhaust chamber of a downward exhaust type, the condenser internal loss out of these losses is classified into a pressure loss occurring in a connecting body part connecting the exhaust chamber of the steam turbine and a condenser main body part and a pressure loss occurring in the condenser main body part. Incidentally, the condenser main body part provides under the connecting body part and has a cooling pipe bundle group to condense steam.

The pressure loss in the connecting body part is a pressure loss in the steam flowing into the connecting body part. This pressure loss greatly depends on the shape of the connecting body part and the disposition of structures such as pipes. Generally, the pressure loss increases in proportion to the square of a flow velocity of the steam. Therefore, it is effective to reduce the flow velocity of the steam by increasing the size of the connecting body part in an allowable range. However, the increase of the size of the connecting body part is restricted by manufacturing cost, arrangement space of a building, and so on.

The connecting body part has a diffuser shape whose passage sectional area increases from its inlet toward its outlet. Inside the connecting body part, structural strength members are installed in addition to pipes such as neck heater pipes and turbine bypass pipes. In order to reduce the pressure loss in such a connecting body part, various studies have been made.

In the above-described connecting body part, the area and shape of the outlet are decided based on the arrangement structure of the cooling pipe bundle group which is required in the condenser main body part. Therefore, a spreading angle of spreading sidewalls of the connecting body part having the diffuser shape is decided by the required area and shape of the outlet of the connecting body part. Note that the spreading angle of the spreading sidewalls is an angle made by a vertical direction and an inner surface of each of the spreading sidewalls.

When the spreading angle of each of the spreading sidewalls becomes larger than a predetermined angle and accordingly the spreading sidewalls spread greatly, the steam flowing from the exhaust chamber of the steam turbine into the connecting body part separates in a passage on the spreading sidewall sides. Consequently, a pressure loss in the steam flowing into the connecting body part increases.

DETAILED DESCRIPTION

In one embodiment, there is provided a condenser disposed under a steam turbine including an exhaust chamber of a downward exhaust type. The condenser includes: a condenser main body part which is disposed under the steam turbine to condense steam; and a connecting body part connecting the exhaust chamber and the condenser main body part and having a pair of lateral sidewalls which face each other in a direction perpendicular to a turbine rotor axial direction of the steam turbine and whose inner wall surfaces are inclined more outward in terms of the perpendicular direction as the inner wall surfaces go more downstream. The condenser further includes a pair of plate-shaped members which are provided on an inner wall surface of at least one of longitudinal sidewalls facing each other in the turbine rotor axial direction and adjacent to the lateral sidewalls, the plate-shaped members being located across a position of an inlet of the connecting body part and on more outer sides than the position of the inlet in terms of the perpendicular direction, projecting in the turbine rotor axial direction, and extending downstream.

Hereinafter, embodiments of the present invention will be described with reference to the drawings.

First Embodiment

Figure 1:
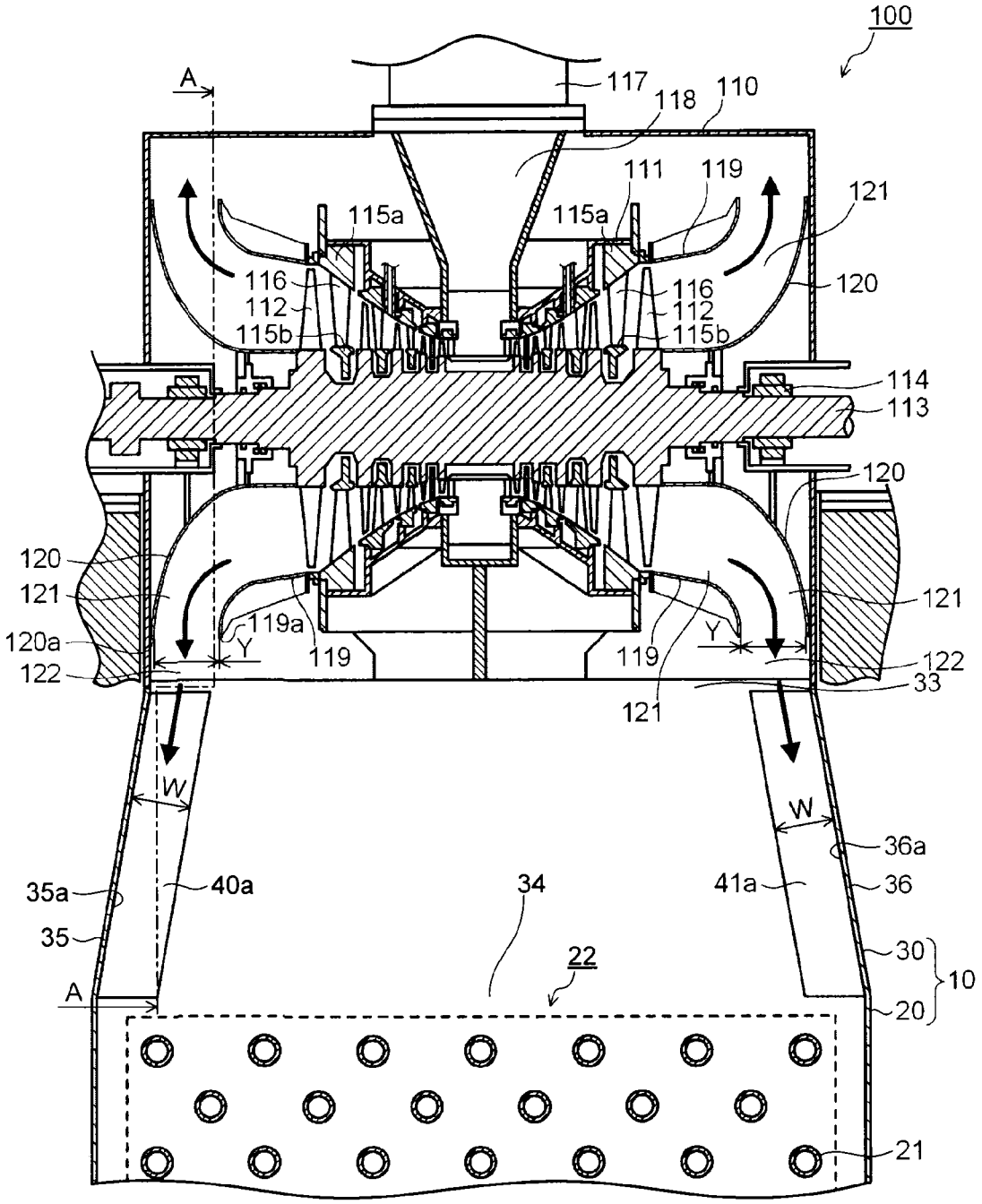
FIG. 1 is a view illustrating a meridian cross section in a vertical direction of a steam turbine including a condenser of a first embodiment.
Figure 2:
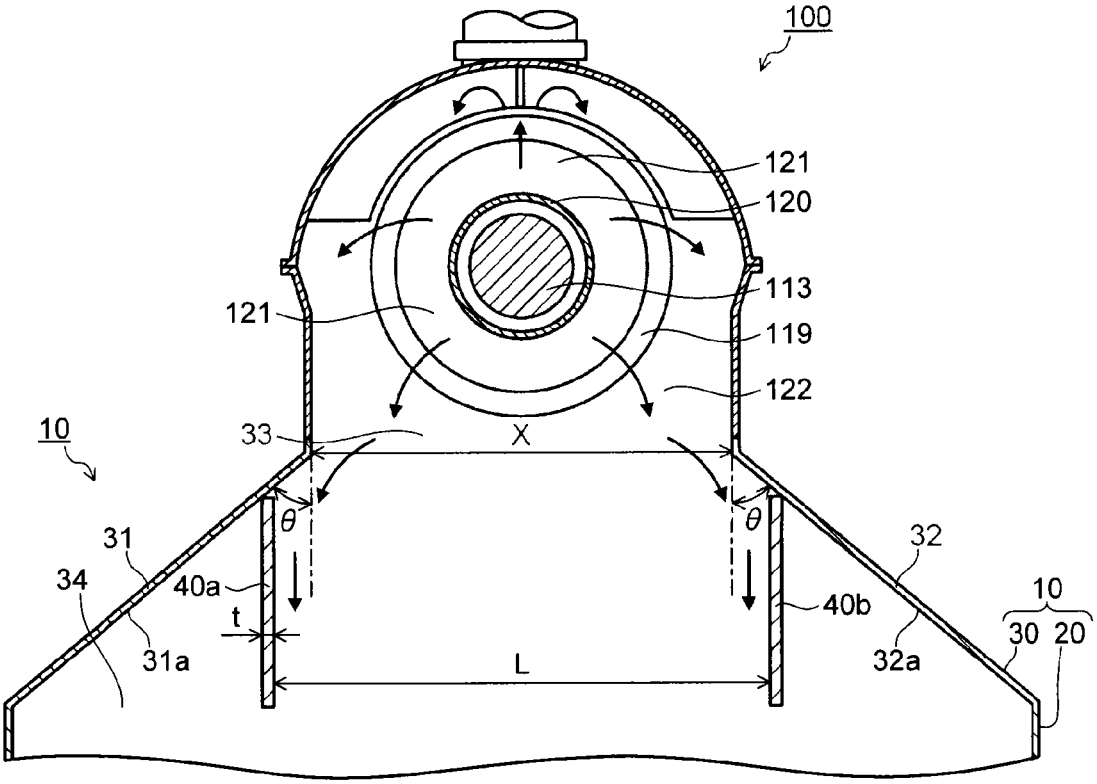
FIG. 2 is a view illustrating a cross section taken along A-A line in FIG. 1.

FIG. 1 is a view illustrating a meridian cross section in a vertical direction of a steam turbine 100 including a condenser 10 of a first embodiment. FIG. 2 is a view illustrating a cross section taken along A-A line in FIG. 1.

In the description here, a low-pressure turbine of a double-flow exhaust type including exhaust chambers of a downward exhaust type is taken as an example of the steam turbine 100. In FIG. 1 and FIG. 2, the flows of steam are indicated by the arrows. Further, in FIG. 1 and FIG. 2, the illustration of pipes such as neck heater pipes and turbine bypass pipes and structural strength members provided in a connecting body part 30 is omitted.

As illustrated in FIG. 1, the condenser 10 is disposed under the steam turbine 100. Here, the structure of the steam turbine 100 will be first described.

An inner casing 111 is provided in an outer casing 110 of the steam turbine 100. In the inner casing 111, a turbine rotor 113 implanted rotor blades 112 is penetratingly disposed. The plural rotor blades 112 are implanted in a circumferential direction to form a rotor blade cascade. A plurality of stages of the rotor blade cascades are provided in a turbine rotor axial direction. The turbine rotor 113 is supported rotatably by a rotor bearing 114.

On an inner circumference of the inner casing 111, stationary blades 116 supported by diaphragms 115*a*, 115*b* are disposed alternately with the rotor blades 112 in the turbine rotor axial direction. The plural stationary blades 116 are supported in the circumferential direction to form a stationary blade cascade. The stationary blade cascade and the rotor blade cascade located on an immediately downstream side of the stationary blade cascade form one turbine stage.

At a center of the steam turbine 100, an intake chamber 118 into which the steam from a crossover pipe 117 is led is provided. From this intake chamber 118, the steam is distributed and led to the left and right turbine stages.

On a downstream side of the final turbine stage, an annular diffuser 121 is formed by a steam guide 119 on an outer circumferential side and a bearing cone 120 on an inner circumferential side thereof. The annular diffuser 121 discharges the steam radially outward. Thus, the steam turbine 100 includes the exhaust chambers 122 of the downward exhaust type having the annular diffuser 121.

Next, the structure of the condenser 10 will be described.

The condenser 10 includes a condenser main body part 20 and the connecting body part 30 as illustrated in FIG. 1. The condenser main body part 20 is disposed under the steam turbine 100 to condense the steam by cooling. The condenser main body part 20 is connected to the exhaust chambers 122 of the steam turbine 100 via the connecting body part 30.

In the condenser main body part 20, for example, a plurality of cooling pipes 21 are disposed to form a cooling pipe bundle group 22 as illustrated in FIG. 1. For example, a cooling medium such as, for example, cooling water flows in the cooling pipes 211. The steam flowing into the condenser main body part 20 via the connecting body part 30 is condensed by coming into contact with the cooling pipes 21, to become condensed water.

The connecting body part 30 has a pair of lateral sidewalls 31, 32 facing each other in a direction (hereinafter referred to as an axis perpendicular direction) perpendicular to a turbine rotor axial direction of the steam turbine 100 as illustrated in FIG. 2. Inner wall surfaces 31*a*, 32*a* of the lateral sidewalls 31, 32 are inclined more outward in terms of the axis perpendicular direction as they go more downstream. Specifically, in the cross section illustrated in FIG. 2, the lateral sidewall 31 is inclined leftward from an inlet 33 of the connecting body part 30, and the lateral sidewall 32 is inclined rightward from the inlet 33 of the connecting body part 30.

In the cross section illustrated in FIG. 2, an angle 0 made by the vertical direction and each of the inner wall surfaces 31*a*, 32*a* is decided by, for example, a set passage sectional area of an outlet 34 of the connecting body part 30. Then, the passage sectional area of the outlet 34 of the connecting body part 30 is decided by, for example, the specifications of the cooling pipe bundle group 22 in the condenser main body part 20 and so on.

Further, as illustrated in FIG. 1, the connecting body part 30 has a pair of longitudinal sidewalls 35, 36 facing each other in the turbine rotor axial direction and adjacent to the lateral sidewalls 31, 32. Inner wall surfaces 35*a*, 36*a* of the longitudinal sidewalls 35, 36 are inclined more outward in terms of the turbine rotor axial direction as they go more downstream, for instance. Specifically, in the cross section illustrated in FIG. 1, the longitudinal sidewall 35 is inclined leftward from the inlet 33 of the connecting body part 30, and the longitudinal sidewall 36 is inclined rightward from the inlet 33 of the connecting body part 30.

It should be noted that the structure of the longitudinal sidewalls 35, 36 is not limited to such an inclined structure, and for example, they may be formed to extend in the vertical direction. The structure of the longitudinal sidewalls 35, 36 is decided by, for example, the specifications of the cooling pipe bundle group 22 in the condenser main body part 20 and so on.

As described above, at least the lateral sidewalls 31, 32 are structured to be inclined more outward in terms of the axis perpendicular direction as they go more downstream. Therefore, the connecting body part 30 forms a steam passage in a diffuser shape whose passage cross section continuously increases as it goes more downstream. The connecting body part 30 is formed in a diffuser shape whose passage cross section perpendicular to a flow direction of the steam has a quadrangular shape as illustrated in FIG. 1 and FIG. 2, for instance.

On the inner wall surface 35*a* of the longitudinal sidewall 35, a pair of plate-shaped members 40*a*, 40*b* projecting in the turbine rotor axial direction and extending downstream are provided as illustrated in FIG. 1 and FIG. 2. Similarly to the inner wall surface 35*a*, on the inner wall surface 36*a* of the longitudinal sidewall 36, a pair of plate-shaped members 41*a*, 41*b* projecting in the turbine rotor axial direction and extending downstream are provided as illustrated in FIG. 1.

As illustrated in FIG. 2, the pair of plate-shaped member 40*a* and plate-shaped member 40*b* are provided across a position of the inlet 33 of the connecting body part 30, on more outer sides than the position of the inlet 33 in terms of the axis perpendicular direction.

In other words, in the cross section illustrated in FIG. 2, the plate-shaped member 40*a* is provided on the inner wall surface 35*a* of the longitudinal sidewall 35 so as to be located more leftward than the inlet 33, and the plate-shaped member 40*b* is provided on the inner wall surface 35*a* of the longitudinal sidewall 35 so as to be located more rightward than the inlet 33.

Note that, similarly to the pair of plate-shaped members 40*a*, 40*b*, the pair of plate-shaped member 41*a* and plate-shaped member 41*b*, though their cross sectional view corresponding to FIG. 2 is not illustrated, are provided across the position of the inlet 33 of the connecting body part 30, on more outer sides than the position of the inlet 33 in terms of the axis perpendicular direction.

The plate-shaped members 40*a*, 40*b* are provided so as to extend in the vertical direction in the cross section perpendicular to the turbine rotor axial direction as illustrated in FIG. 2. In FIG. 2, a distance L between the plate-shaped member 40*a* and the plate-shaped member 40*b* is preferably set so that, for example, L/X falls within a range of 1.1 to 1.7, where X is a width of the inlet 33 of the connecting body part 30 in the axis perpendicular direction.

A reason why L/X is preferably within this range is that, before the flow spreading in the axis perpendicular direction along the longitudinal sidewall 35 separates, the spread can be restricted by the plate-shaped members 40*a*, 40*b*. Consequently, it is possible to prevent the separation of the flow along the lateral sidewalls 31, 32. Note that this description regarding the plate-shaped members 41*a*, 41*b* also applies to the plate-shaped members 40*a*, 40*b*.

A projection width W of each of the plate-shaped members 40*a*, 40*b*, 41*a*, 41*b* in the turbine rotor axial direction is set constant as illustrated in FIG. 1, for instance. Here, the projection width W is a width in a direction perpendicular to the inner wall surfaces 35*a*, 36*a* in FIG. 1. The projection width W is preferably equal to or smaller than an outlet width Y of the annular diffuser 121 in the turbine rotor axial direction.

For example, as illustrated in FIG. 1, when an outlet-side endmost portion 119*a* of the steam guide 119 and an outlet-side endmost portion 120*a* of the bearing cone 120 are on the same level, the outlet width Y is a distance between the endmost portion 119*a* and the endmost portion 120*a*. On the other hand, when the outlet-side endmost portion 119*a* of the steam guide 119 and the outlet-side endmost portion 120*a* of the bearing cone 120 are not on the same level, the outlet width Y is the shortest distance from the outlet-side endmost portion 119*a* of the steam guide 119 to the bearing cone 120.

A reason why the projection width W is preferably within this range here is that it is possible to lead the steam flowing out from the annular diffuser 121 to areas between the plate-shaped member 40*a* and the plate-shaped member 40*b* and between the plate-shaped member 41*a* and the plate-shaped member 41*b*, to lead the steam to the condenser main body part 20 without excessively blocking the flow of the steam.

Incidentally, the plate-shaped members 40*a*, 40*b*, 41*a*, 41*b* each have, for example, a constant thickness t. The plate-shaped members 40*a*, 40*b*, 41*a*, 41*b* are preferably provided, for example, up to a boundary of the connecting body part 30 and the condenser main body part 20 as illustrated in FIG. 1 and FIG. 2.

The plate-shaped members 40*a*, 40*b*, 41*a*, 41*b* are provided on the longitudinal sidewalls 35, 36 on the sides where the outlets of the exhaust chambers 122 are provided. Since the low-pressure turbine of the double-flow exhaust type is illustrated as the steam turbine 100 here, the exhaust chambers 122 exist at two places in the turbine rotor axial direction respectively. Therefore, the plate-shaped members 40*a*, 40*b* and the plate-shaped members 41*a*, 41*b* are provided on the longitudinal sidewall 35 and the longitudinal sidewall 36 respectively.

Incidentally, for example, when the number of the exhaust chamber 122 is one as in a case where a low-pressure turbine of a single-flow exhaust type is used as the steam turbine 100, the plate-shaped members are provided only on the longitudinal sidewall on the side where the outlet of the exhaust chamber 122 is provided.

Next, the flow of the steam in the condenser 10 will be described.

Since the flow of the steam is the same on the longitudinal sidewall 35 side and the longitudinal sidewall 36 side, the flow on the longitudinal sidewall 35 side will be described here.

For example, the steam discharged from an upper half of the annular diffuser 121 flows into the exhaust chambers 122, with its flow direction changed downward, while spreading also in the turbine rotor axial direction. The steam flowing into the connecting body part 30 from the exhaust chambers 122 flows downstream to flow into the condenser main body part 20.

On the other hand, the steam flowing out from a lower half of the annular diffuser 121 to the exhaust chambers 122 to flow into the connecting body part 30 flows along the longitudinal sidewall 35 in the connecting body part 30 while spreading toward the lateral sidewalls 31, 32, that is, in the axis perpendicular direction. At this time, the steam flowing out into the connecting body part 30 is restricted in its spread in the axis perpendicular direction by the plate-shaped members 40*a*, 40*b* in the cross section illustrated in FIG. 2 and flows between the plate-shaped member 40*a* and the plate-shaped member 40*b* toward the downstream condenser main body part 20.

That is, the steam flowing out into the connecting body part 30 flows between the plate-shaped member 40*a* and the plate-shaped member 40*b* toward the downstream condenser main body part 20 without influenced by the inclination of the lateral sidewalls 31, 32. As described above, the steam flowing out from the lower half of the annular diffuser 121 to the exhaust chambers 122 to flow out into the connecting body part 30 does not flow along the lateral sidewalls 31, 32 which are on more outer sides than the plate-shaped members 40*a*, 40*b* in terms of the axis perpendicular direction.

Therefore, even when the angle θ made by the vertical direction and each of the inner wall surfaces 31*a*, 32*a* is set to such an angle as to cause the flow along the inner wall surfaces 31*a*, 32*a* to separate, the steam flows toward the condenser main body part 20 without any separation of the flow being caused.

The steam flowing into the condenser main body part 20 comes into contact with the cooling pipes 21 to be condensed by cooling, thereby becoming condensed water. The condensed water is stored in, for example, a bottom portion of the condenser main body part 20 and is led to a boiler and so on again by a feed pump or the like.

As described above, according to the condenser 10 of the first embodiment, providing the plate-shaped members 40*a*, 40*b*, 41*a*, 41*b* causes the steam to flow into the condenser main body part 20 without separating in the connecting body part 30. This can reduce the pressure loss in the connecting body part 30.

Figure 3:
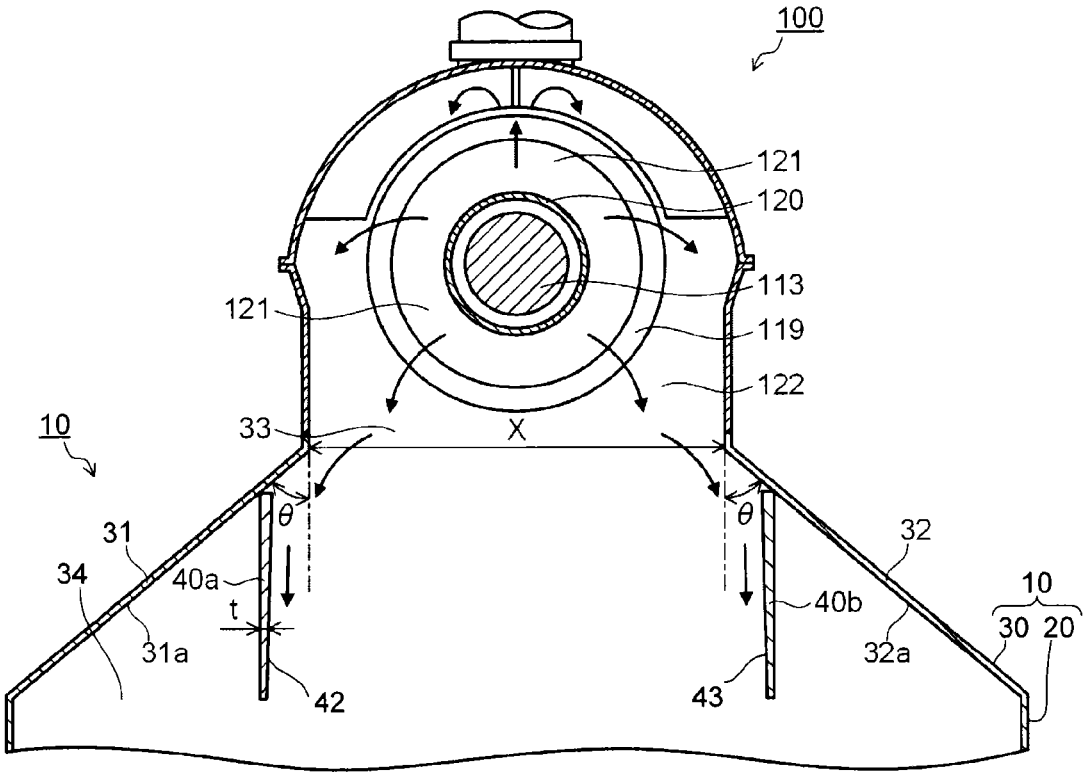
FIG. 3 is a view illustrating a cross section corresponding to the cross section taken along A-A line in FIG. 1, of a steam turbine including the condenser of the first embodiment having plate-shaped members in another shape.

Here, the structure of the plate-shaped members 40*a*, 40*b*, 41*a*, 41*b* in the condenser 10 of the first embodiment is not limited to the above-described structure. FIG. 3 is a view illustrating a cross section corresponding to the cross section taken along A-A line in FIG. 1, of the steam turbine 100 including the condenser 10 of the first embodiment having plate-shaped members 40*a*, 40*b* in another shape. Note that, though the structure of the plate-shaped members 40*a*, 40*b* is described here, the structure of the plate-shaped members 41*a*, 41*b* is also the same.

As illustrated in FIG. 3, a thickness t of the plate-shaped members 40*a*, 40*b* may become gradually smaller as they go more downstream. For example, facing surfaces 42, 43 of the plate-shaped member 40*a* and the plate-shaped member 40*b* may be inclined surfaces inclined more outward in terms of the axis perpendicular direction as they go more downstream.

When the surfaces 42, 43 are such inclined surfaces, an area between the plate-shaped member 40*a* and the plate-shaped member 40*b* becomes a passage whose width increases as it goes more downstream. Consequently, a diffuser effect is obtained between the plate-shaped member 40*a* and the plate-shaped member 40*b*, which can further reduce the pressure loss.

Figure 4:
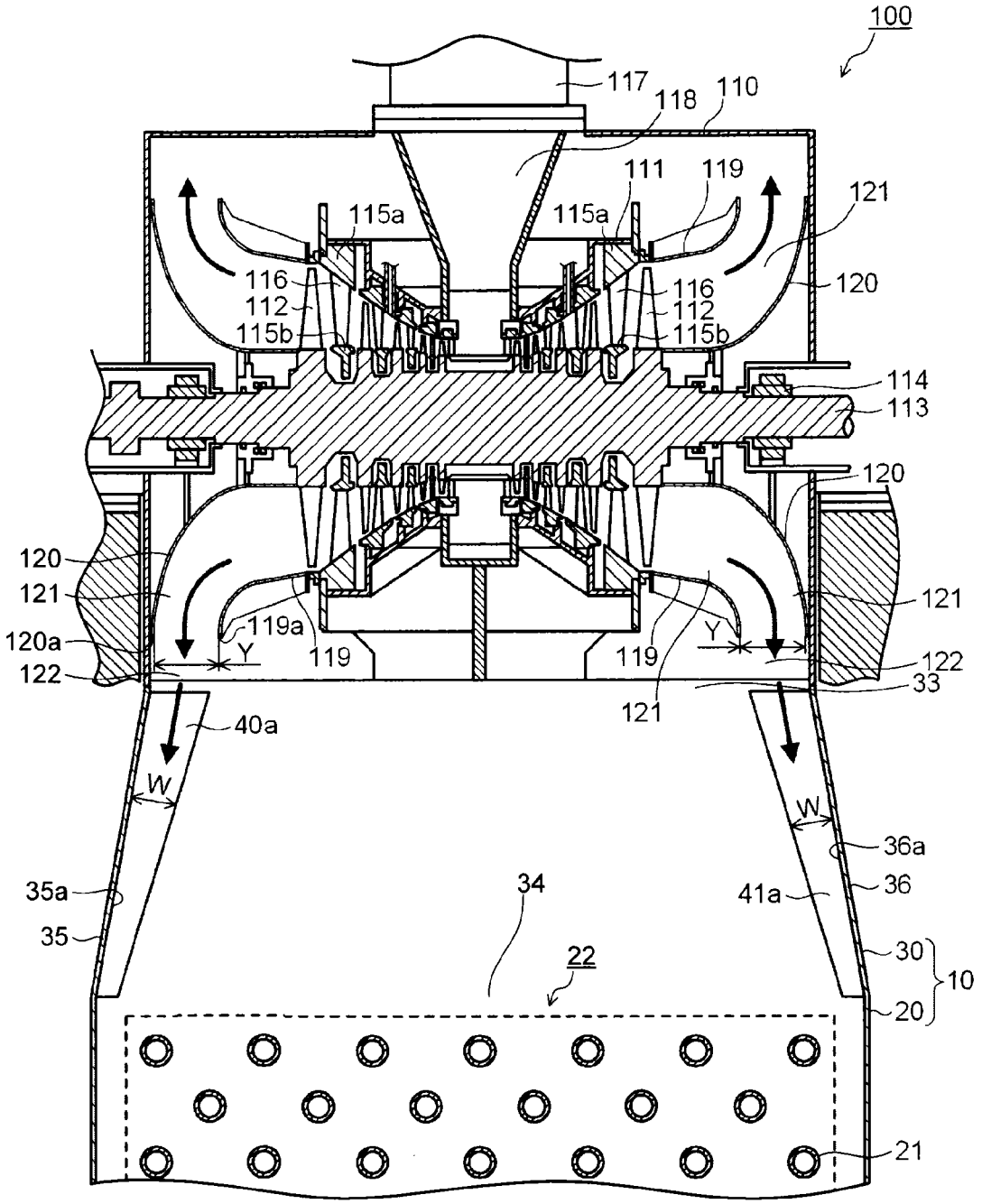
FIG. 4 is a view illustrating a meridian cross section in the vertical direction of the steam turbine including the condenser of the first embodiment having plate-shaped members in another shape.

FIG. 4 is a view illustrating a meridian cross section in the vertical direction of the steam turbine 100 including the condenser 10 of the first embodiment having plate-shaped members 40*a*, 40*b*, 41*a*, 41*b* in another shape.

As illustrated in FIG. 4, a projection width W of each of the plate-shaped members 40*a*, 40*b*, 41*a*, 41*b* may become narrower as it goes more downstream. In this case, the projection width W of an exhaust chamber-side end portion of each of the plate-shaped members 40*a*, 40*b*, 41*a*, 41*b* is preferably equal to or smaller than the outlet width Y of the annular diffuser 21.

When the plate-shaped members 40*a*, 40*b*, 41*a*, 41*b* have such a structure, on the upstream side in the connecting body part 30, it is possible to lead the steam flowing out from the annular diffuser 121 to areas between the plate-shaped member 40*a* and the plate-shaped member 40*b* and between the plate-shaped member 41*a* and the plate-shaped member 41*b*, and at the same time, on the downstream side, it is possible to reduce the contact area between the steam and the plate-shaped members 40*a*, 40*b*, 41*a*, 41*b*. This can further reduce the pressure loss of the steam flowing between the plate-shaped member 40*a* and the plate-shaped member 40*b* and between the plate-shaped member 41*a* and the plate-shaped member 41*b*.

Second Embodiment

Figure 5:
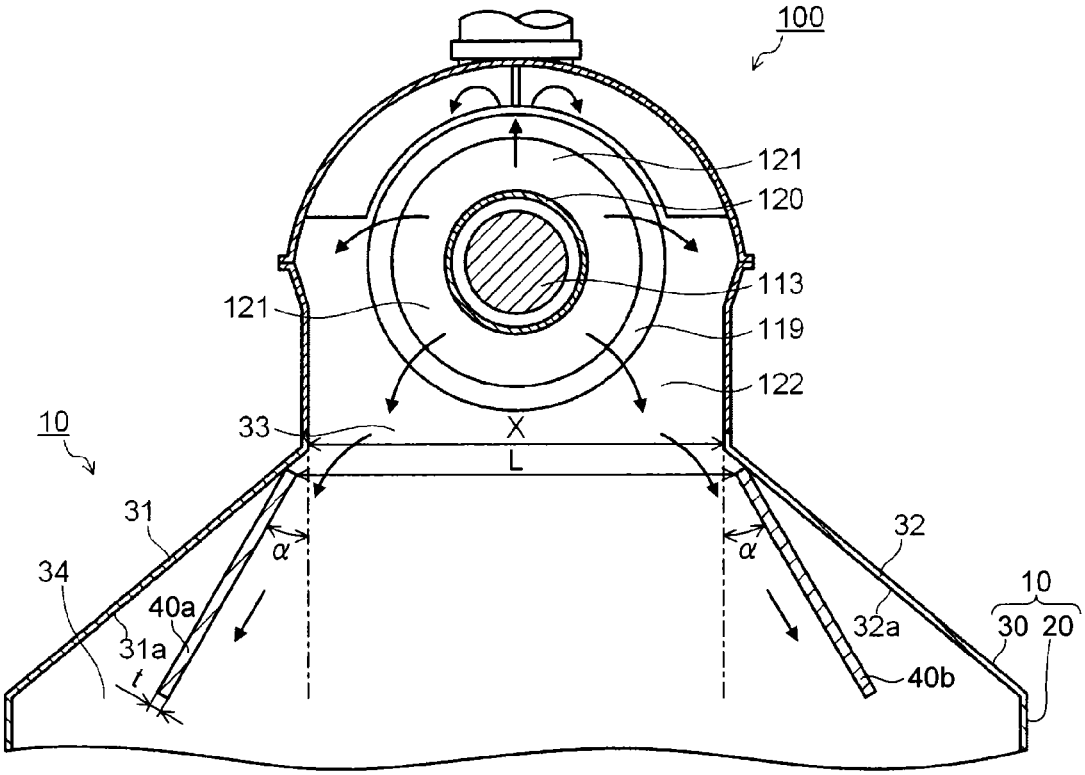
FIG. 5 is a view illustrating a cross section corresponding to the cross section taken along A-A in FIG. 1, of a steam turbine including a condenser of a second embodiment.

FIG. 5 is a view illustrating a cross section corresponding to the cross section taken along A-A line in FIG. 1, of a steam turbine 100 including a condenser 10 of a second embodiment. Constituent parts having the same structures as those of the condenser 10 of the first embodiment will be denoted by the same reference signs, and redundant description thereof will be omitted or simplified.

The condenser 10 of the second embodiment has the same structure as the structure of the condenser 10 of the first embodiment except the arrangement structure of plate-shaped members 40*a*, 40*b*. Therefore, the arrangement structure of the plate-shaped members 40*a*, 40*b* will be mainly described here. Note that the structure of plate-shaped members 41*a*, 41*b* is also the same as the structure of the plate-shaped members 40*a*, 40*b*.

As illustrated in FIG. 5, the plate-shaped members 40*a*, 40*b* are provided, being inclined toward lateral sidewalls 31, 32 in a cross section perpendicular to a turbine rotor axial direction. Concretely, the plate-shaped member 40*a* is provided, being inclined toward the lateral sidewall 31, that is, outward in terms of an axis perpendicular direction. Further, the plate-shaped member 40*b* is provided, being inclined toward the lateral sidewall 32, that is, outward in terms of the axis perpendicular direction.

In the cross section illustrated in FIG. 5, an angle a made by each of the plate-shaped members 40*a*, 40*b* and a vertical direction is set to an angle smaller than an angle which causes the flow of steam along their surfaces separates between the plate-shaped member 40*a* and the plate-shaped member 40*b*. Note that the angle a is an acute angle out of angles made by each of the plate-shaped member 40*a*, 40*b* and the vertical direction.

Here, when the plate-shaped members 40*a*, 40*b* are provided in the inclined manner as described above, the distance L between the plate-shaped member 40*a* and the plate-shaped member 40*b* illustrated in FIG. 2 becomes a distance between an upstream end portion of the plate-shaped member 40*a* and an upstream end portion of the plate-shaped member 40*b* as illustrated in FIG. 5.

By thus inclining the plate-shaped members 40*a*, 40*b*, an area between the plate-shaped member 40*a* and the plate-shaped member 40*b* becomes a passage whose width increases as it goes more downstream. Consequently, a diffuser effect is obtained between the plate-shaped member 40*a* and the plate-shaped member 40*b*, which can further reduce the pressure loss.

According to the condenser 10 of the second embodiment, by providing the plate-shaped members 40*a*, 40*b*, 41*a*, 41*b*, it is possible to prevent the separation of the flow of the steam in the connecting body part 30 to reduce the pressure loss. Further, by inclining the plate-shaped members 40*a*, 40*b*, it is possible to further reduce the pressure loss in the connecting body part 30.

Note that the structure of the plate-shaped members 40*a*, 40*b*, 41*a*, 41*b* illustrated in FIG. 3 and FIG. 4, which is described in the first embodiment, is also applicable to the second embodiment. Then, the same operation and effect as the operation and effect in the first embodiment can be obtained.

According to the above-described embodiments, it is possible to reduce the pressure loss in the connecting body part connecting the exhaust chambers of the steam turbine and the condenser main body part.

In the description of the above embodiments, the low-pressure turbine of the double-flow exhaust type including the exhaust chambers of the downward exhaust type is taken as an example of the steam turbine 100, but the steam turbine 100 is not limited to this. The steam turbine 100 may be any, provided that it includes the exhaust chamber of the downward exhaust type, and may have an exhaust chamber of, for example, a single-flow exhaust type.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A condenser disposed under a steam turbine including an exhaust chamber of a downward exhaust type, the condenser comprising:

a condenser main body part which is disposed under the steam turbine to condense steam;

a connecting body part connecting the exhaust chamber and the condenser main body part and having a pair of lateral sidewalls which face each other in a direction perpendicular to a turbine rotor axial direction of the steam turbine and whose inner wall surfaces are inclined more outward in terms of the perpendicular direction as the inner wall surfaces go more downstream; and a pair of plate-shaped members which are provided on an inner wall surface of at least one of longitudinal sidewalls facing each other in the turbine rotor axial direction and adjacent to the lateral sidewalls, the plate-shaped members being located across a position of an inlet of the connecting body part and on more outer sides than the position of the inlet in terms of the perpendicular direction, projecting in the turbine rotor axial direction, and extending downstream.

2. The condenser according to claim 1, wherein an outlet of the exhaust chamber is provided on at least one side out of the pair of lateral sidewalls; and wherein the plate-shaped members are provided on the longitudinal sidewall on the side where the outlet of the exhaust chamber is provided.

3. The condenser according to claim 1, wherein the plate-shaped members are provided to extend in a vertical direction in a cross section perpendicular to the turbine rotor axial direction.

4. The condenser according to claim 1, wherein the plate-shaped members are inclined toward the lateral sidewalls in a cross section perpendicular to the turbine rotor axial direction.

5. The condenser according to claim 1, wherein the steam turbine includes an annular diffuser which is provided on a downstream side of a final turbine stage to lead steam passed through the final turbine stage to the exhaust chamber; and wherein a projection width of the plate-shaped members in the turbine rotor axial direction is equal to or smaller than an outlet width of the annular diffuser in the turbine rotor axial direction.

6. The condenser according to claim 1, wherein the steam turbine includes an annular diffuser which is provided on a downstream side of a final turbine stage to lead steam passed through the final turbine stage to the exhaust chamber; and wherein a projection width of an exhaust chamber-side end portion of each of the plate-shaped members in the turbine rotor axial direction is equal to or smaller than an outlet width of the annular diffuser in the turbine rotor axial direction, and the projection width becomes narrower toward a downstream side.

7. The condenser according to claim 1, wherein a thickness of the plate-shaped members becomes smaller toward a downstream side.

* * * * *